US007302816B1

(12) United States Patent
Lu

(10) Patent No.: US 7,302,816 B1
(45) Date of Patent: Dec. 4, 2007

(54) COMBINED COMPUTER SECURITY LOCK AND SECURITY CABLE

(75) Inventor: Francisco Lu, Kaohsiung (TW)

(73) Assignee: Miz Engineering Ltd. (TW)

( * ) Notice: Subject to any disclaimer, the term of this patent is extended or adjusted under 35 U.S.C. 154(b) by 0 days.

(21) Appl. No.: 11/521,444

(22) Filed: Sep. 15, 2006

Related U.S. Application Data

(60) Provisional application No. 60/760,391, filed on Jan. 20, 2006.

(51) Int. Cl.
*E05B 69/00* (2006.01)

(52) U.S. Cl. ..... 70/58; 70/14; 70/18; 70/49

(58) Field of Classification Search ..... 70/57, 70/58, 14, 18, 19, 30, 49
See application file for complete search history.

(56) References Cited

U.S. PATENT DOCUMENTS

| | | | | |
|---|---|---|---|---|
| 5,875,657 | A * | 3/1999 | Kelley | 70/18 |
| 6,000,252 | A * | 12/1999 | Murray, et al. | 70/58 |
| 6,257,029 | B1 * | 7/2001 | Liao | 70/58 |
| 6,321,579 | B1 * | 11/2001 | Reyes | 70/58 |
| 6,401,502 | B1 * | 6/2002 | Yang | 70/30 |
| 6,601,416 | B1 * | 8/2003 | Sanders | 70/58 |
| 6,619,081 | B1 * | 9/2003 | Yu | 70/58 |
| 6,672,117 | B2 * | 1/2004 | Yu | 70/58 |
| 6,880,373 | B2 * | 4/2005 | Ling | 70/58 |
| 6,918,272 | B1 * | 7/2005 | Sanders | 70/58 |
| 6,968,716 | B1 * | 11/2005 | Ling | 70/14 |
| 6,973,809 | B2 * | 12/2005 | Chang | 70/58 |
| 2003/0106349 | A1 * | 6/2003 | Broadbridge et al. | 70/58 |

* cited by examiner

*Primary Examiner*—Suzanne Dino Barrett
(74) *Attorney, Agent, or Firm*—Davidson Berquist Jackson & Gowdey LLP

(57) ABSTRACT

A computer security lock includes a main housing, a key-operated lock having a lock housing disposed in the main housing and having a lock bar extending movably through the lock housing, and a pair of scissors-type levers. Each lever has opposite proximal and distal end portions, and a medial part between the proximal and distal end portions. The distal end portion has a hook extending outwardly of the main housing to engage a slot in a computer housing. The medial parts of the levers are pivoted to the main housing at a common pivot point. The proximal end portions of the levers are biased to place the hooks in an unlatching position in which the hooks overlap. A cam is moved by the lock bar to extend toward and between the proximal end protions so that the hooks move away from each other. A cable holder extends around the main housing, and a security cable is connected pivotally to the cable holder.

9 Claims, 5 Drawing Sheets

COMBINED COMPUTER SECURITY LOCK AND SECURITY CABLE

CROSS-REFERENCE TO RELATED APPLICATION

This application claims priority from Provisional Application No. 60/760,391 filed on Jan. 20, 2006.

BACKGROUND OF THE INVENTION

1. Field of the Invention

The present invention relates to a computer security lock that can be fixed to a computer, more particularly to a combined computer security lock and security cable incorporating a latch mechanism that has a pair of scissors-type levers respectively provided with hooks to engage a slot provided in a computer housing.

2. Description of the Related Art

With the development of improved multimedia storage and display and the development of wireless networking, the so-called notebook or laptop computer has become increasingly popular. However, the portability of the notebook computer gives rise to concerns that the notebook computer is a tempting target for thieves. In order to deter thieves, a security cable may be attached to the computer. The security cable has a loop at one end so that the cable can be wrapped around a fixed object, such as a pipe, or a hole formed through a desk, or other work surface for the purpose, and the opposite end of the cable is equipped with a lock attachable to the notebook computer.

It is known to provide a notebook computer with a rectangular slot in a housing wall thereof to receive a latch mechanism of a Kensington™ lock made by Kensington Microwave Limited of San Mateo, Calif. A typical Kensington™ lock is a tubular lock having a rotatable T-shaped shaft extending from a lock body. In operation, a crossbar of the T-shaped shaft is inserted through the rectangular slot in the housing wall of the notebook computer, and a key is inserted in the lock and is rotated by 90° in order to rotate the crossbar of the T-shaped shaft so that the crossbar cannot be pulled back through the rectangular slot, thereby latching the lock to the notebook computer.

Some security cable assemblies are equipped with a separate mount or adaptor that can be secured to a sidewall of a computer housing either by a rotatable T-shaped shaft similar to the latch mechanism of the Kensington™ lock, or by adhesive so that a lock with a different lock bar or latch mechanism may be used with the security cable assembly.

Some locks have been developed with either one or two hooks for engaging a slot in the sidewall of a computer housing. However, these locks require using a key to secure the lock to the computer, and have to rely on a rotating cam mechanism to move the hook(s) behind the sidewall. Some security cable locks are equipped with a push button, but the push button is obliquely aligned with the axis of a lock bar. Some security cable locks do not require a key, but use a combination lock with a rotating cam or lock bar mechanism.

Consequently, conventional notebook computer security cables either require a separate adaptor for connection to the computer, or require that a key be inserted into the lock and rotated to secure the lock to the computer, or require complex rotating cam mechanisms for attachment to the computer. In addition, many security cable locks require the use of washers or spacers to adjust the length of the lock bar for a snug fit against the sidewall of the computer housing, or use a complex arrangement of springs for the same purpose. Further, conventional notebook computer security cables are rigidly attached to the lock housing, thereby shortening the effective length of the cable, limiting the choice of anchors to secure the cable thereto, and frequently resulting in tangling of the cable. Thus, a latch mechanism for a notebook computer security lock solving the aforementioned problems is desired.

SUMMARY OF THE INVENTION

An object of the present invention is to provide a computer security lock with a novel and simple latch mechanism for engaging a slot in a computer housing.

Another object of the present invention is to provide a combined computer security lock and security cable that has a cable capable of swivelling to provide flexibility and convenience in attaching the cable to a fixed anchor and to reduce an incidence of entanglement.

According to one aspect of the present invention, a computer security lock includes: a main housing having opposite first and second ends; a key-operated lock having a lock housing disposed in the main housing proximate to the first end, and a lock bar extending through the lock housing to move longitudinally; and a pair of levers. Each of the levers has opposite proximal and distal end portions, and a medial part disposed between the proximal and distal end portions. The distal end portion has a hook extending outwardly of the second end of the main housing and adapted to engage a slot in a computer housing. The medial parts of the levers are pivoted to the main housing at a common pivot point and proximate to the second end. The proximal end portions of the levers are biased to place the hooks of the levers in an unlatching position in which the hooks overlap. A cam is associated with the lock bar and is moved by the lock bar to extend toward and between the proximal end protions and to push the proximal end portions so that the hooks move away from each other.

According to another aspect of the present invention, there is provided a combined computer security lock and security cable which comprises: a main housing having opposite first and second ends; a cable holder disposed around the main housing between the first and second ends; a security cable having one end pivotally attached to the cable holder and another end adapted for attachment to a fixed anchor; a key-operated lock disposed in the main housing; and a latch mechansim disposed in the main housing and actuated by the key-operated lock. The latch mechansim projects outward from the main housing and is adatpted to engage a slot formed in a computer housing.

DETAILED DESCRIPTION OF THE PREFERRED EMBODIMENTS

Figure 1:
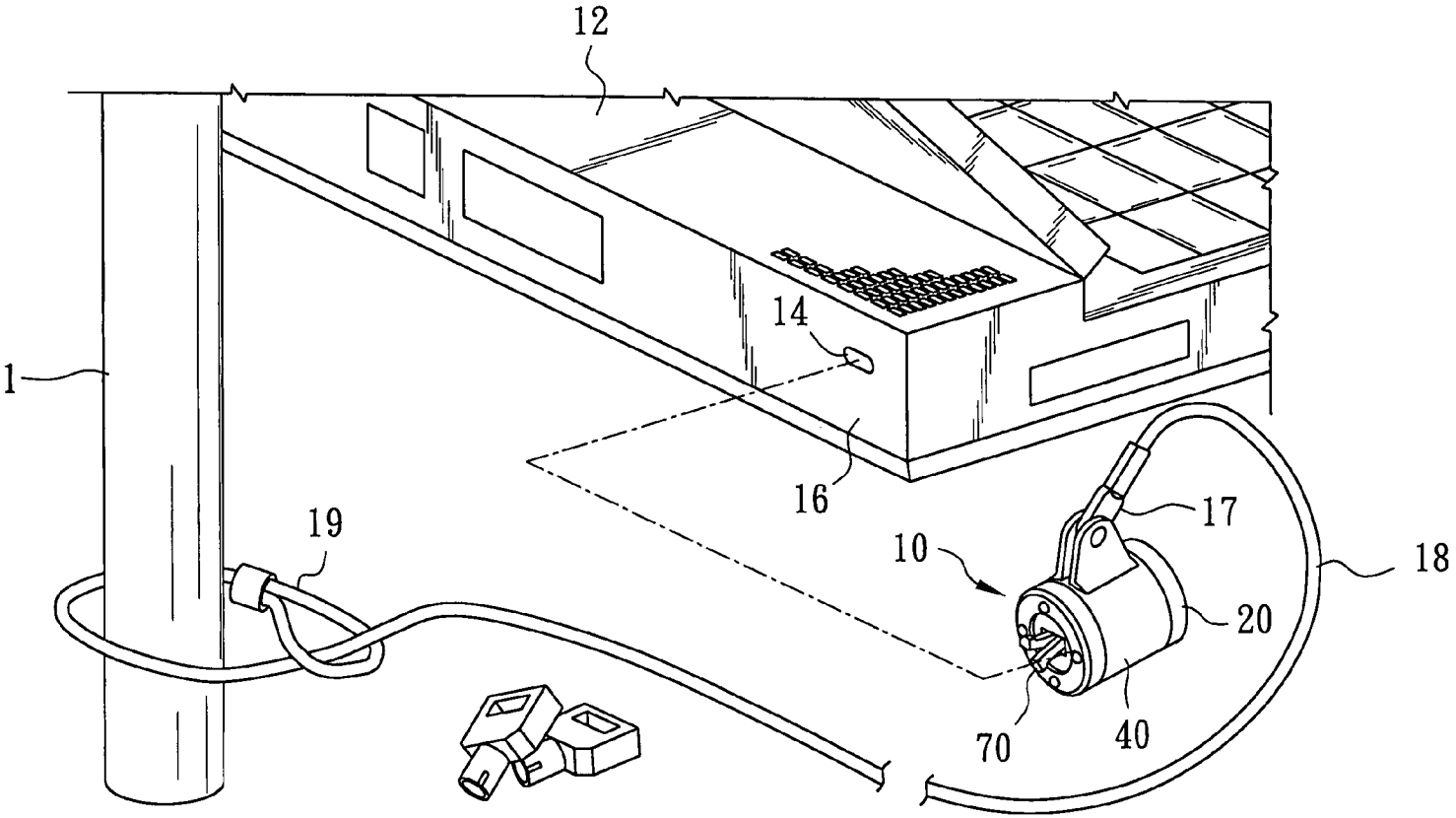
FIG. 1 is an environmental, perspective view of a combined computer security lock and security cable according to the present invention.
Figure 2:
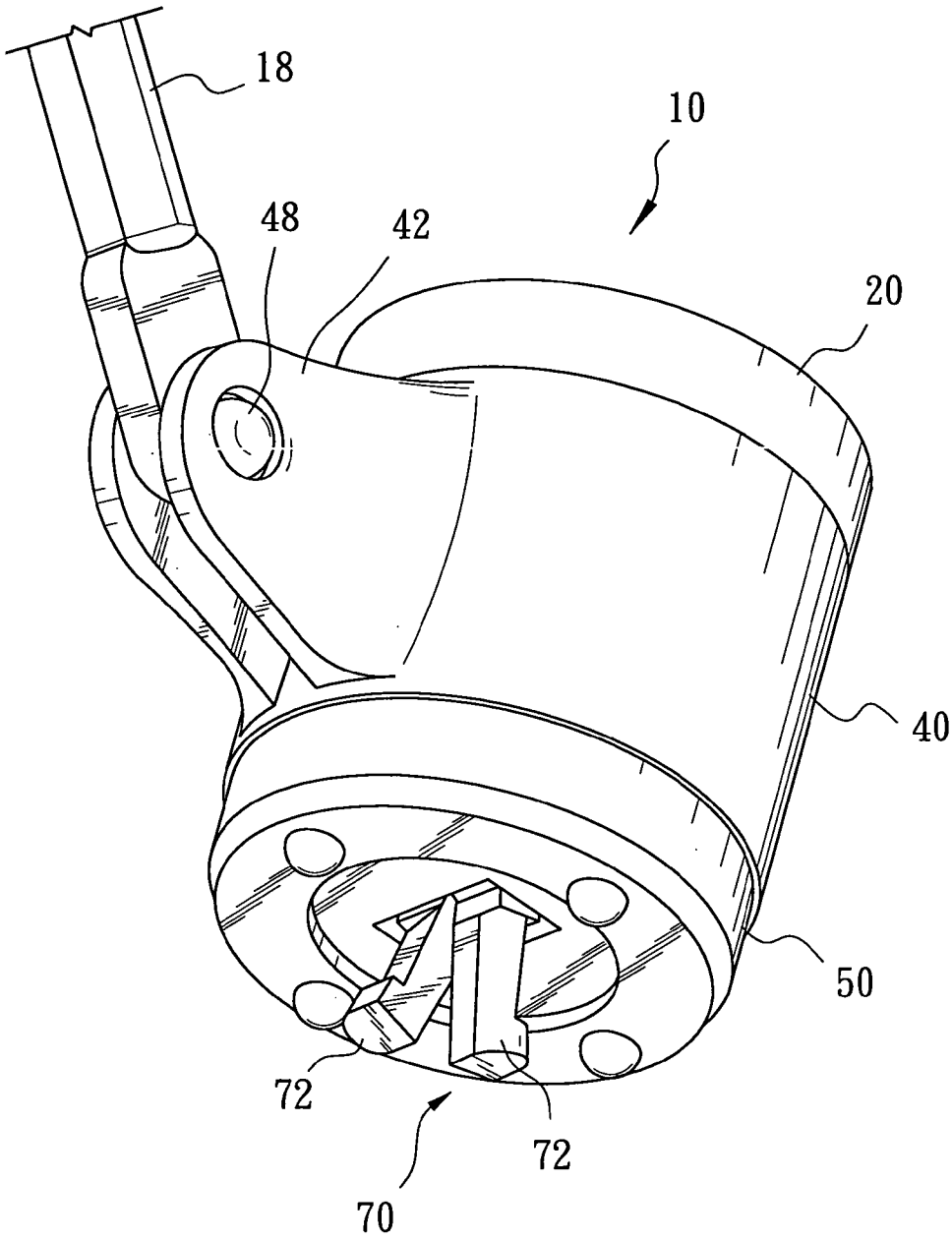
FIG. 2 is an enlarged perspective view of the combined computer security lock and security cable of FIG. 1.
Figure 3:
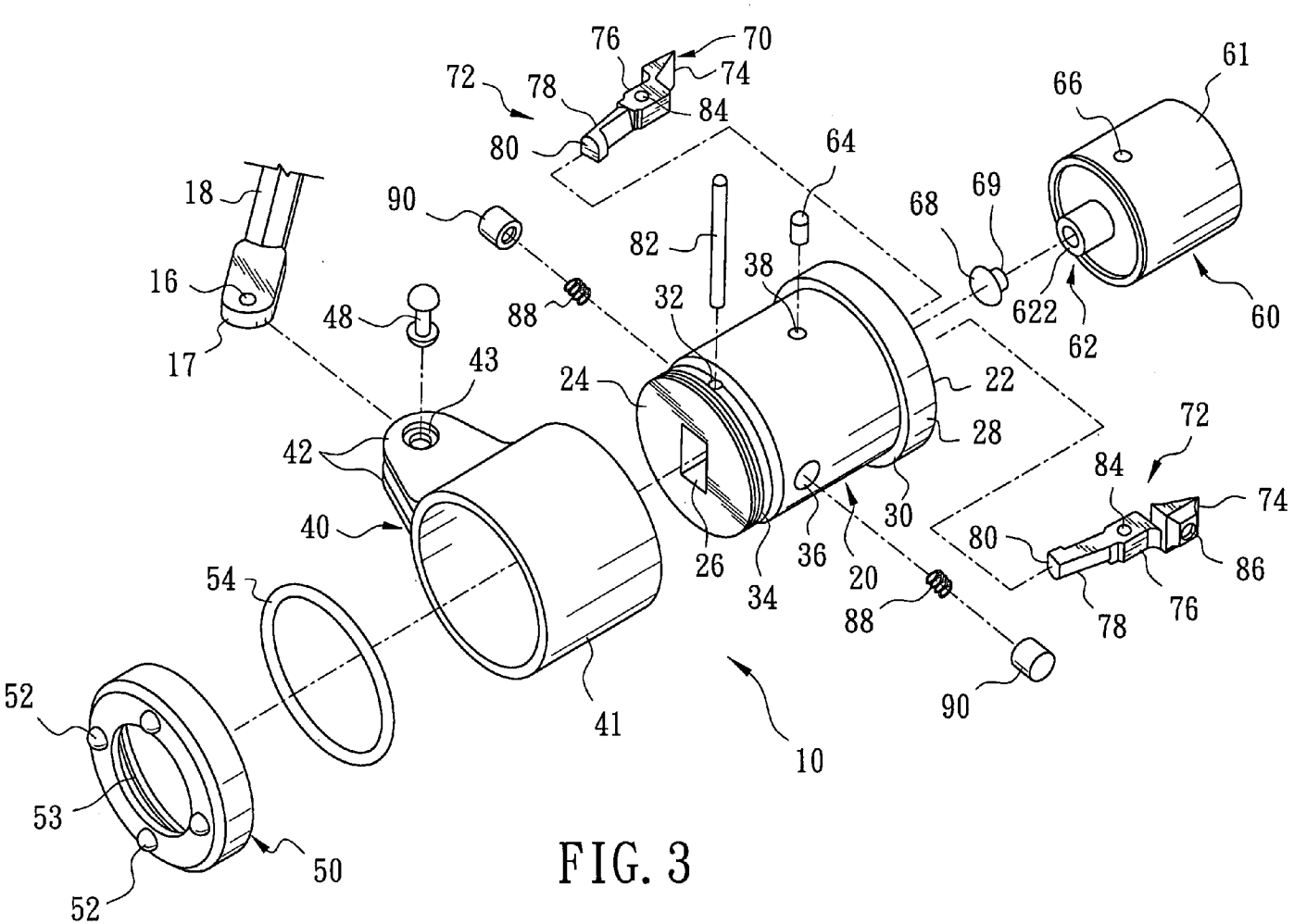
FIG. 3 is an exploded view of the combined computer security lock and security cable of FIG. 2.

Referring to FIG. 1, there is shown a computer security lock 10 combined with a security cable 18 according to a preferred embodiment of the present invention, which are used for locking a computer, such as a notebook computer 12. The notebook computer 12 has a generally rectangular slot 14 provided in a sidewall 16 of a computer housing for engaging the computer security lock 10. The security cable 18 is used to connect the computer security lock 10 to a fixed anchor, such as a post 1. An end of the security cable 18 opposite to the computer security lock 10 is provided with a loop 19 for attachment to the post 1.

Referring to FIGS. 2-5, the computer security lock 10 includes a substantially cylindrical main housing 20, a cable holder 40, an end cap 50, a key-operated cylindrical lock 60, and a latch mechanism 70. The main housing 20 is generally cylindrical and has opposite first and second ends 22, 24. The second end 24 is a closed end having a slot 26 defined therein. The first end 22 of the main housing 20 is an open end provided with a raised rim 28 that defines an annular shoulder 30. An external thread 34 is formed around the main housing 20 adjacent to the second end 24.

The cable holder 40 has a tubular wall 41 that is sleeved around the main housing 10, and a pair of lugs 42 extending laterally from the tubular wall 41. Each of the lugs 42 has a bore 43 defined therethrough. The cable 18 has a flat terminal 17 formed with a hole 16. A pivot pin 48 extends through the aligned bores 43 in the lugs 42 and the hole 16 in the flat terminal 17 so that the cable 18 is attached pivotally to the lugs 42 of the cable holder 40. The cable 18 therefore can swivel for convenient attachment to the computer 12 and to the fixed anchor or the post 1.

The end cap 50 is annular and has an internally threaded skirt 53. The end cap 50 is sleeved onto the second end 24 of the main housing 20. The internally threaded skirt 53 is engaged threadedly with the external thread 34 of the main housing 20. The end cap 50 is made from plastic, and the outer surface of the end cap 50 has a plurality of resilient hemispherical protrusions 52 that are annularly spaced apart from each other and that serve to maintain proper spacing between the main housing 20 and the sidewall 16 of the computer 12. A retaining ring 54 is disposed between the end cap 50 and the tubular wall 41 of the cable holder 40 so that the cable holder 40 can be pressed tightly against the annular shoulder 30 and cannot rotate relative to the main housing 20.

The key-operated lock 60 has a cylindrical lock housing 61 disposed in the main housing 20 proximate to the first end 22, and an axially slidable lock bar 62 is inserted axially through the lock housing 61. The key-operated lock 60 is secured against rotation within the main housing 20 by a lock pin 64 that is inserted through a lock pin bore 38 provided in the main housing 20 and that seats in a lock pin hole 66 formed in the lock housing 61. The lock pin 64 is retained in the lock pin bore 38 by the cable holder 40 that extends around the main housing 20. The key-operated lock 60 is conventional and may be any lock having an axially slidable lock bar, preferably a tubular lock having a push button. An example of the key-operated lock 60 is described in U.S. Pat. No. 5,133,203, issued Jul. 28, 1992, which is hereby incorporated by reference in its entirety.

In this embodiment, the lock bar 62 has opposite press end 621 and push end 622, and is movable between first and second positions. The press end 621 of the lock bar 62 is movable to project out of the first end 22 of the main housing 20 to its first position, or to be pressed inward from its first position to its second position. The push end 622 is movable to extend out of the lock housing 61 in a direction toward the second end 24 of the main housing 20 when the lock bar 62 is pressed inward to move to its second position.

A substantially dome-shaped cam 68 is attached integrally to the push end 622 of the slide bar 62. As shown in the drawings, the push end 622 of the lock bar 62 is hollow, and the cam 68 has a stem 69 that may be threaded for attachment to the push end 622 of the lock bar 62, or that may be attached to the push end 622 by a pressure fit. The cam 68 may, however, be attached to the lock bar 62 by any means suitable to the structure of the lock bar 62, and may have any desired shape.

The latch mechanism 70 includes a pair of elongated levers 72. Each lever 72 has a proximal end portion 74 disposed within the main housing 20, a distal end portion 78 projecting outward from the slot 26 of the second end 24 of the main housing 20, and a medial part 76 disposed between the proximal and distal end portions 74, 78. The distal end portion 78 of each lever 72 has a hook 80.

The main housing 20 further has a radial pivot pin bore 32 formed through the threaded portion of the main housing 20 proximate to the second end 24. A pair of diametrically opposite spring bores 36 extends through the main housing 20 proximate to the threaded portion of the main housing 20. Spring retainers 90 are fitted respectively in the spring bores 36.

The levers 72 are pivotally attached to the main housing 20 proximate to the second end 24 by a common pivot pin 82 extending through the radial pivot pin bore 32 in the main housing 20 and through bores 84 formed respectively in the medial parts 76 of the levers 72 so that the levers 72 can pivot relative to each other like the blades of a pair of scissors. The proximal end portions 74 of the levers 72 are respectively provided with blind bores 86 therein, and are biased by springs 88. Each spring 88 is a compression spring that has one end extending into the corresponding spring bore 36 in abutment with the corresponding spring retainer 90 and another end seated in the blind bore 86 in the corresponding lever 72. The spring retainers 90 are retained respectively in the spring bores 36 by the tubular wall 41 of the cable holder 40, which extends around the main housing 20 and covers the spring bores 36, whereas the pivot pin 82 is retained in the radial pivot pin bore 32 by the end cap 50 that covers the pivot pin bore 32.

When the key-operated lock 60 is in an unlocking position, the push button 67 at the press end 621 of the lock bar 62 projects out of the first end 22 of the main housing 20 to its first position so that the cam 68 on the push end 622 of the lock bar 62 does not move toward the proximal end portions 74 of the levers 72. In this state, the proximal end portions 74 are biased by the springs 88 so that the hooks 80 overlap.

When the push button 67 at the press end 621 is pressed inward, the key-operated lock 60 is placed in a locking position, and the cam 68 at the press end 622 moves to and between the proximal end portions 74 of the levers 72 so that the proximal end portions 74 are pushed by the cam 68 against the biasing actions of the springs 88 and are moved further apart from each other, thereby moving the hooks 80 away from each other.

Therefore, when the push button 67 is not pressed inward, the hooks 80 may be inserted into the slot 14 in the sidewall 16 of the notebook computer 12. In this state, the hooks 80 overlap and are in an unlatching position so that the slot 14 is not engaged with the hooks 80 and the notebook computer 12 is not connected to the computer security lock 10 and the security cable 18. When the push button 67 is pressed inward, the hooks 80 are in a latching position in which the hooks move away from each other. In this state, the hooks 80 lodge behind the sidewall 16 and engage opposite ends of the slot 14. The resilient protrusions 52 of the end cap 50 serve to abut against the sidewall 16 of the notebook computer 12 when the hooks 80 engage the slot 14. Due to the resiliency of the protrusions 52, the hooks 80 can be prevented assuredly from moving either axially or angularly, thereby firmly connecting the computer security lock 10 and the security cable 18 to the notebook computer 12.

When the key-operated lock 60 is operated through a key, the push button 67 projects outward, and the cam 68 and the lock bar 62 retract within the lock housing 61, so that the springs 88 expand to force the proximal end portions 74 towards each other until the hooks 80 overlap thereby enabling the computer security lock 10 to be removed from the slot 14 of the notebook computer 12.

Figure 4:
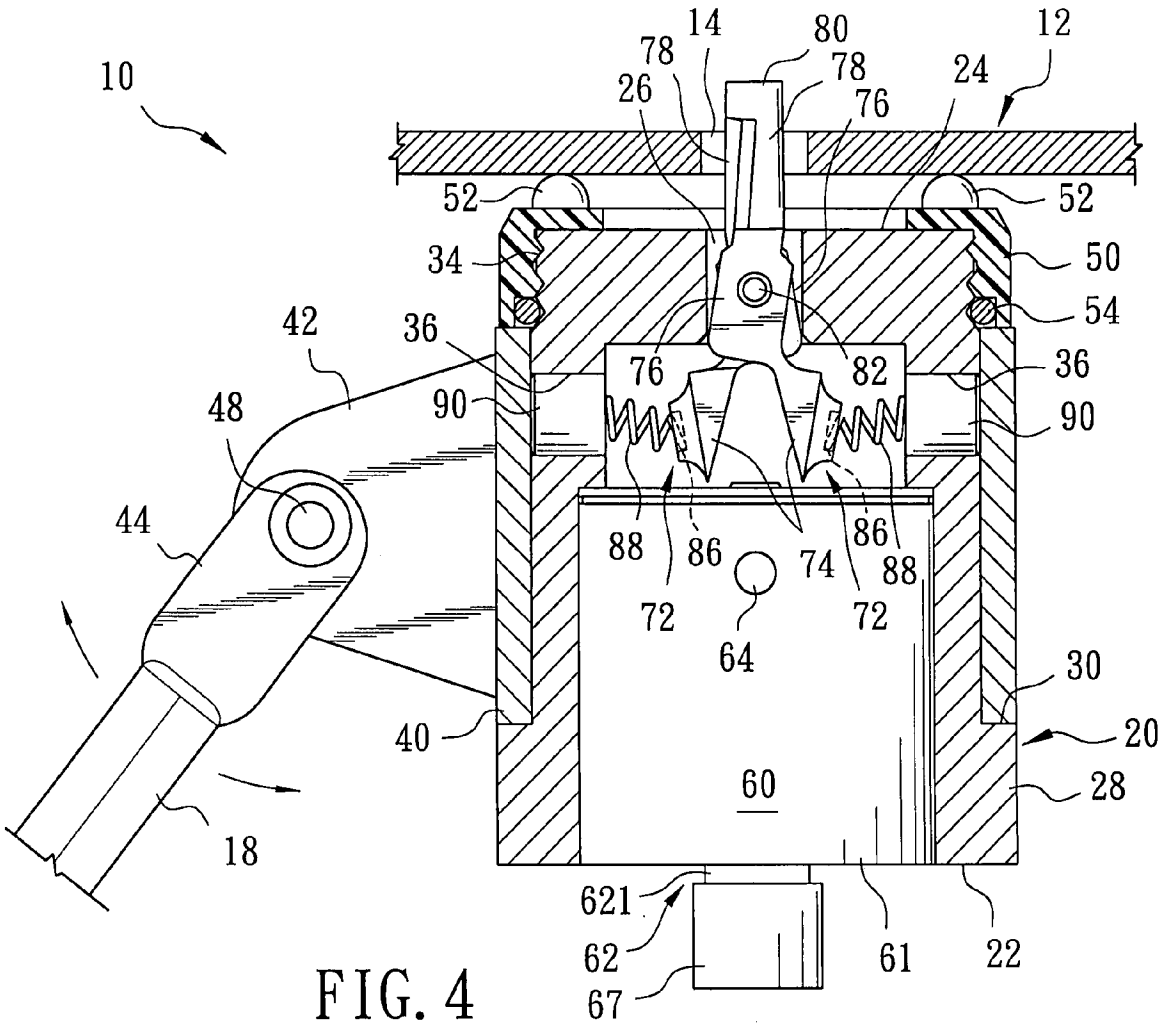
FIG. 4 is a sectional view of the combined computer security lock and security cable of FIG. 2.
Figure 5:
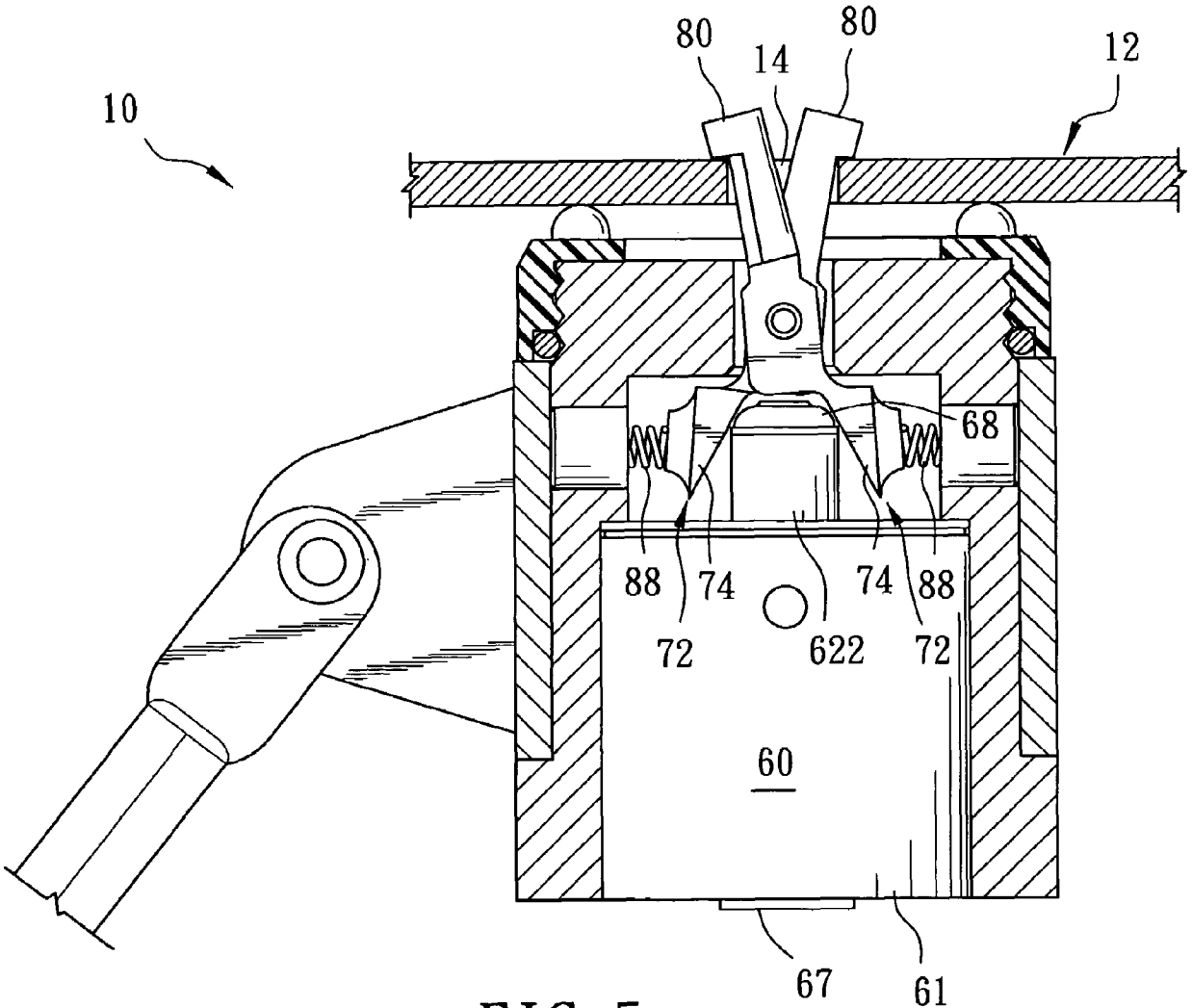
FIG. 5 is the same view as FIG. 4, but showing that hooks are moved away from each other.

The distal end portions 78 of the levers 72 may be constrained to stop rotation when the hooks 80 overlap by friction between the distal end portions 78, by sloping the surfaces of the distal end portions 78, by providing at least one of the distal end portions 78 with a laterally extending flange on its trailing edge, or by any other suitable stop so that the hooks 80 overlap in the unlatching position (as shown in FIG. 4) to provide a low profile for insertion through the slot 14 in the sidewall 16 of the notebook computer 12.

It is to be understood that the present invention is not limited to the embodiments described above, but encompasses any and all embodiments within the scope of the following claims.

I claim:

1. A computer security lock comprising:

a main housing having opposite first and second ends and having an axis extending through said first and second ends;

a key-operated lock having a lock housing disposed in said main housing proximate to said first end, and a lock bar extending through said lock housing, said lock bar having a press end and being movable axially to project out of said first end of said main housing and to be pressed into said main housing;

a pair of levers, each of said levers having opposite proximal and distal end portions, and a medial part disposed between said proximal and distal end portions, said distal end portion having a hook extending outwardly of said second end of said main housing and adapted to engage a slot formed in a computer housing, said medial parts of said levers being pivoted to said main housing at a common pivot point and proximate to said second end;

a spring unit disposed within said main housing and biasing said proximal end portions of said levers to move toward each other; and a cam associated with said lock bar and movable axially along with said lock bar, wherein, when said press end is pressed, said cam extends toward and between said proximal end portions and pushes said proximal end portions away from each other so that said hooks move away from each other.

2. The computer security lock of claim 1, wherein said lock bar further has a push end opposite to said press end and movable toward said proximal end portions of said levers so that said cam is moved by said push end to push said proximal end portions.

3. The computer security lock of claim 2, wherein said cam is attached integrally to said lock bar at said push end.

4. The computer security lock of claim 2, further comprising a common pivot pin connecting pivotally said medial parts to said main housing at said common pivot point.

5. The computer security lock of claim 1, further comprising a cable holder that includes a tubular wall extending around said main housing, a pair of lugs projecting outward from said tubular wall, and a security cable having one end connected pivotally to said lugs.

6. The computer security lock of claim 5, wherein said main housing further has an annular shoulder proximate to said first end, an external thread formed around said main housing proximate to said second end, and an end cap capping said second end and having an internally threaded skirt engaging said external thread, said tubular wall of said cable holder being pressed against said annular shoulder by said end cap.

7. The computer security lock of claim 6, wherein said main housing further has a pivot pin bore formed through said main housing, and a pivot pin connecting pivotally said levers to said main housing, said pivot pin extending through said pivot pin bore, said end cap covering said pivot pin bore and preventing said pivot pin from being released from said pivot pin bore.

8. The computer security lock of claim 1, wherein said spring unit includes two springs that bias said proximal end portions, respectively.

9. The computer security lock of claim 8, wherein said main housing further has two spring bores, and two spring retainers inserted respectively into said spring bores, each of said springs having one end connected to one of said levers and another end extending into one of said spring bores, each of said spring retainers being disposed between said another end of a respective one of said springs and said tubular wall of said cable holder, said tubular wall covering said spring bores and preventing said spring retainers from being released from said spring bores.

* * * * *